US005246252A

United States Patent [19]

Gaddis

[11] Patent Number: 5,246,252

[45] Date of Patent: Sep. 21, 1993

[54] APPARATUS AND METHOD FOR ASSEMBLING AND DISPLAYING INFORMATION

[75] Inventor: Lee Gaddis, Marietta, Ga.

[73] Assignee: Thomas Carlyle Scales, Atlanta, Ga.

[21] Appl. No.: 816,158

[22] Filed: Dec. 31, 1991

Related U.S. Application Data

[63] Continuation-in-part of Ser. No. 746,911, Aug. 19, 1991.

[51] Int. Cl.[5] ..... B42D 15/00

[52] U.S. Cl. ..... 283/98; 281/15.1; 283/99; 283/63.1

[58] Field of Search ..... 281/15.1; 283/63.1, 283/99, 117, 98, 61

[56] References Cited

U.S. PATENT DOCUMENTS

| | | | |
|---|---|---|---|
| 48,681 | 7/1865 | Hawley | 283/63.1 |
| D. 173,363 | 11/1954 | Louis | 283/63.1 X |
| 483,715 | 10/1892 | Fisher | 281/15.1 |
| 803,360 | 10/1905 | Price | 283/63.1 |
| 1,638,277 | 8/1927 | Smith | 281/15.1 |
| 4,984,825 | 1/1991 | Fowler | 283/99 |

*Primary Examiner*—Mark Rosenbaum
*Assistant Examiner*—Willmon Fridie, Jr.
*Attorney, Agent, or Firm*—Jones & Askew

[57] ABSTRACT

A group of cards containing printed information on one or more selected topics and interconnected to form a deck of such cards. The deck may include a title card bearing indicia denoting a particular topic of information on other cards in the deck, and also may include one or more cards containing general information on the topic, as well as subject cards containing information on one or more specific items relating to the topic. The subject cards include indicia, preferably along a marginal portion of the card, denoting the particular subject for which that card, or the facing surface of the card, contains information. Cards for a deck are laid out with only front sides of the cards printed on the front surface of card stock and only back sides of the cards printed on the back surface of the card stock, so that all cards making up the deck bow in the same direction and no unsightly split appears in the deck.

2 Claims, 5 Drawing Sheets

PLANTS
10
11
12
13

31
31b
35
42
43
40
LILY
41
DESCRIPTION:
44
CARE:
14

32a
32
35
45
SALVIA
46
DESCRIPTION:
CARE:
14
31a
31
35
38
COLEUS
33
39
34
DESCRIPTION:
CARE:
14

35
25
25a
HELPFUL HINTS
27
28
26
14
18a
18
20
TABLE OF CONTENTS
21
19
OUTDOOR PLANTS
SHRUBS
14
12
PLANTS
14
13
50
48
ATLANTA
SCHEDULE:
49
47
47a

62a

| | | | | | |
|---|---|---|---|---|---|
| 1 | 49 | 9 | 57 | 17 | 65 |
| 2 | 50 | 10 | 58 | 18 | 66 |
| 3 | 51 | 11 | 59 | 19 | 67 |
| 4 | 52 | 12 | 60 | 20 | 68 |

(FRONT)

62b

| | | | | | |
|---|---|---|---|---|---|
| 32 | 80 | 40 | 88 | 48 | 96 |
| 31 | 79 | 39 | 87 | 47 | 95 |
| 30 | 78 | 38 | 86 | 46 | 94 |
| 29 | 77 | 37 | 85 | 45 | 93 |

(BACK)

63a

| | | | | | |
|---|---|---|---|---|---|
| 5 | 53 | 13 | 61 | 21 | 69 |
| 6 | 54 | 14 | 62 | 22 | 70 |
| 7 | 55 | 15 | 63 | 23 | 71 |
| 8 | 56 | 16 | 64 | 24 | 72 |

(FRONT)

63b

| | | | | | |
|---|---|---|---|---|---|
| 28 | 76 | 36 | 84 | 44 | 92 |
| 27 | 75 | 35 | 83 | 43 | 91 |
| 26 | 74 | 34 | 82 | 42 | 90 |
| 25 | 73 | 33 | 81 | 41 | 89 |

(BACK)

65

FIG 6

APPARATUS AND METHOD FOR ASSEMBLING AND DISPLAYING INFORMATION

CROSS-REFERENCE TO RELATED APPLICATION

This is a continuation-in-part of U.S. Ser. No. 07/746,911 filed Aug. 19,1991.

FIELD OF INVENTION

This invention relates in general to displaying information, and in particular relates to apparatus utilizing a series of cards bearing information on one or more selected topics and to a method for preparing such decks.

BACKGROUND OF THE INVENTION

People often find themselves in situations where they need or desire information concerning a particular topic. These situations may relate either to work or to leisure activities, but the desired information usually is not readily at hand unless an appropriate book or other information source is available. Although the information may be available from various reference sources such as periodical publications, books, or databases accessible through computers, these sources are not readily portable and in many cases are relatively expensive to purchase and maintain.

Problems associated with providing a convenient source of information on a selected topic are even greater where the information source should be readily portable, that is, sufficiently compact in size and weight so that a person will want to carry it with him or her. Regular hardback bound books are out of the question in most cases, due to the weight and bulk of such books. Even paperback books, although somewhat more convenient to carry than their hardback counterparts, usually do not fit conveniently within a person's pockets, and must instead be carried in a knapsack or some other carrier borne by the individual. Moreover, the bulk and space requirements of conventional bookbinding reduce the amount of information each page can display, and add to the number of pages required for a given amount of information, a significant factor for a portable or easily-carried compendium of information. Moreover, the very nature of bound books makes these books relatively inconvenient or expensive to modify as the information on a few pages is changed from time to time, and the conventional looseleaf alternative to binding usually adds to the weight and physical bulk of a book.

The invention disclosed in U.S. Ser. No. 07/746,911 and incorporated herein comprises a number of individual cards containing information and compiled in a particular sequence. The individual cards are assembled to make up a deck of cards, and the deck is joined together by a fastener such as a rivet or the like extending through aligned holes formed adjacent a corner of each card. This construction permits fanning the deck to display a particular card containing information of interest to a person using the deck.

The individual cards for the decks described in the aforementioned copending application were prepared by choosing the information desired for the front and back faces of each card, and then printing that information on the respective sides of each card making up a deck on a particular topic. Each such deck has n cards in any specific embodiment and the entire deck thus consists of 2n faces.

For reasons of economical and practical production, such information decks are prepared in commercial quantities by laying out and printing a number of individual card faces on one surface of a sheet of card stock that is many times larger than an individual card face. The card faces printed on the front surface of each card-stock sheet can be for different cards in the set, or can be multiple copies of the same card face, or can be some mixture thereof. The back faces for those cards then are printed on the other surface of the card stock in registry with the card faces initially printed on the front surface. After both surfaces of the card-stock sheets are thus printed, the individual cards are cut from the sheets. Those individual cards then are assembled into one or more decks in the desired sequence of information printed on the card faces, and the cards are drilled to accommodate the rivet that secures together the cards of a deck.

When manufacturing decks of cards in the manner described above, it became apparent that the assembled decks displayed a visible gap or split separating the deck into two or more groups of cards. This split is unsightly and gives an unfavorable commercial impression of an inferior or poorly-fabricated product not suitable for marketing to the public.

SUMMARY OF INVENTION

Accordingly, it is an object of the present invention to provide improved apparatus for assembling and displaying information.

It is another object of the present invention to provide a relatively compact and easily portable information display apparatus.

It is yet another object of the present invention to organize information on particular subjects relating to a selected topic, and to organize information according to different groups of subjects relating to that topic.

It is a further object of the present invention to provide an improved method for producing an interconnected deck of cards assembled in predetermined order, and to provide an improved product made according to that method.

Stated in general terms, the present invention includes a number of individual sheets mutually interconnected to maintain a predetermined sequential arrangement of the sheets. Each sheet has a front surface and a back surface, and at least some of those surfaces bear indicia containing information on particular subjects relating to a selected topic. One sheet, such as the first sheet in the sequence, preferably bears indicia indicating the particular topic of information contained on others of the sheets. The assembly of sheets may also include one or more sheets in the form of an index or table of contents, identifying the information contained on other sheets or surfaces and indicating the particular sheet or surface location containing that information.

Stated somewhat more particularly, the sheets are cards interconnected to form a deck of cards having the predetermined sequential arrangement, and the information on particular subjects relating to a topic is printed on at least one side, and preferably both sides, of each card. The cards preferably are not bound together as pages of a conventional book, but instead are interconnected by a suitable fastener extending through an opening in each card making up the deck.

Stated with further particularity, the cards making up a deck according to the present invention are joined together by a rigid fastener such as a rivet extending through holes formed adjacent a particular corner of the cards. This fastener maintains the cards in the form of a deck, but allows pivoting the cards about the fastener so as to fan the cards on an axis of alignment extending through the aligned openings in the cards making up the deck. The card containing information on a particular subject relating to the topic of the deck is readily accessible by fanning the deck to reach that card, and then pivoting the preceding cards of the deck about the fastener to leave the desired card in substantially full view.

Decks according to the present invention include separate indicia along a marginal portion of each subject card, denoting that subject or a particular attribute of the subject, or both. Where a deck of cards contains information on different groups of subjects relating to a common topic for that deck, the marginal information of the subject cards can denote a specific group of subjects. Other indicia on each card, preferably in the marginal portion thereof, can denote the particular subject within a group or subgroup of subjects.

The problem of assembled decks that contained unsightly splits dividing the decks into distinct groups of cards was overcome according to the present invention through the discovery that the splits were caused by a slight bowing or warping of the cards. This bowing arises from the grain structure of the card stock imparted during the papermaking process, and resulted in individual cards that are slightly warped instead of being absolutely flat as one would expect of cards cut from nominally-flat sheets of card stock. With the discovery that the individual cards are bowed when cut from the card stock, it was then realized that the prior layout of card faces for printing on the card-stock sheets involved placing front sides of one group of cards on the front surfaces of those sheets, and placing front sides of another group of cards on the back surfaces of those sheets. It then was understood that when cards were cut from the sheets and collated into decks, the one group of cards was front-surface up in the deck but cards of the other group were turned over to be back-surface up, because the front sides printed on the back surface must face the front of the deck. This meant that cards of the first group were bowed in one direction while cards of the second group, having been turned over before compilation into the deck, were bowed in the opposite direction. It was thus discovered that these opposite directions of bowing caused the aforementioned split which appeared between the two groups of cards in the assembled deck. This split is eliminated in the present invention by laying out the card sides so that only front sides are on the front surface of the card stock and only back sides are on the back surface of the card stock. Decks are assembled from such cards without turning over any card making up a deck, so that all cards of the deck bow in the same direction and avoid creating an unsightly split in the deck.

Other objects and advantages of the present invention will become more readily apparent from the following description of a preferred embodiment.

BRIEF DESCRIPTION OF THE DRAWING

FIG. 6 shows a typical prior-art layout of card sides used for preparing the deck of FIG. 5.

DETAILED DESCRIPTION OF PREFERRED EMBODIMENT

Figures 1, 2, 3, 4:
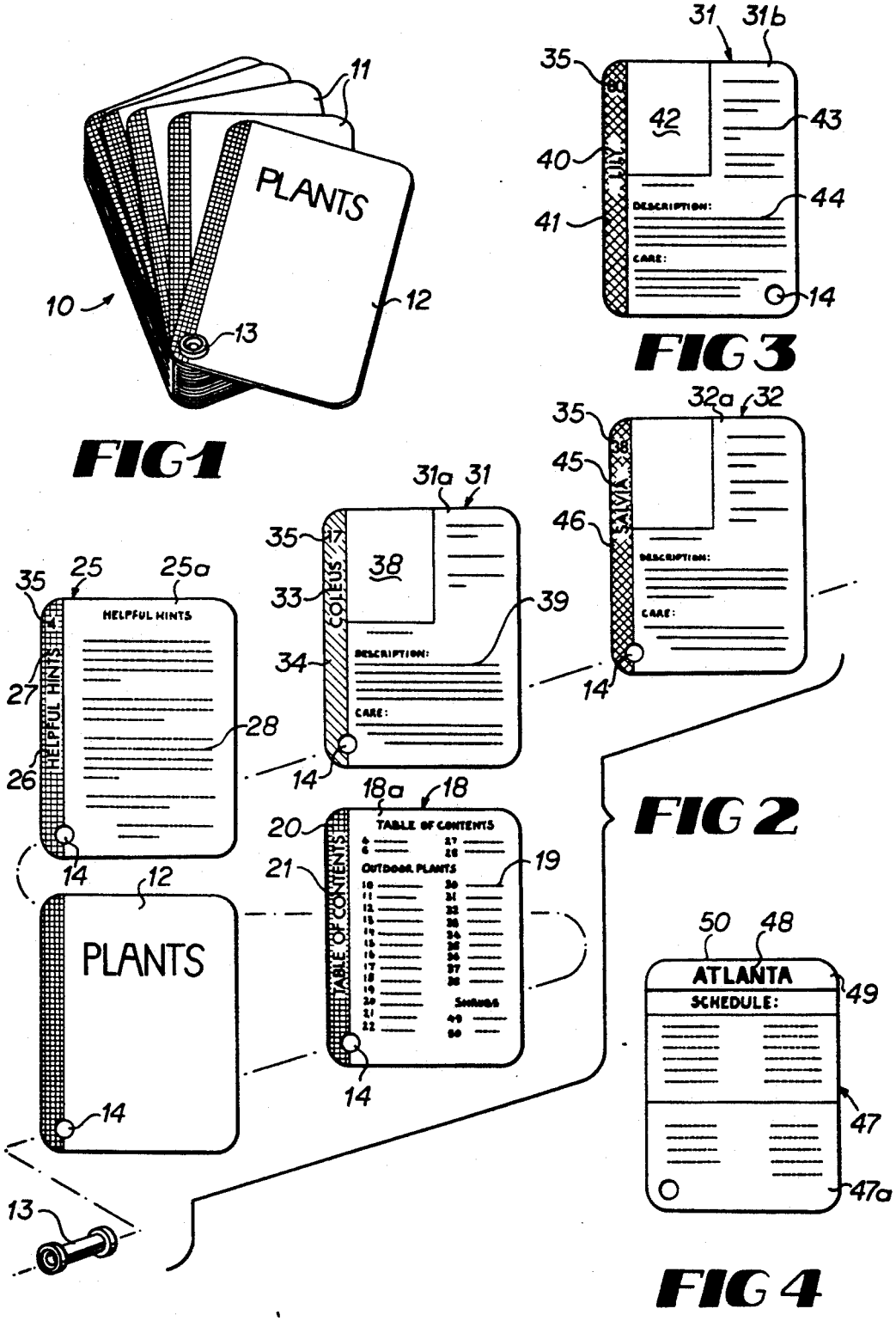
FIG. 1 is a pictorial view showing a partially-fanned deck of information-bearing cards according to a preferred embodiment of the present invention.
FIG. 2 is an exploded view showing representative cards from the deck in FIG. 1.
FIG. 3 shows the back side of one card in the deck of FIGS. 1 and 2.
FIG. 4 shows a typical information card from another deck according to a modification of the preferred embodiment.

Turning first to FIG. 1, there is shown generally at 10 a deck of individual cards 11 containing printed information about a selected topic. In the specific embodiment shown in FIGS. 1 and 2, the topic pertains to horticulture as denoted by the word "plants" printed on the front surface of the card 12 at the top of the deck. The cards 11 are secured togehter in the deck assemblage by means of a fastener 13 such as a molded plastic rivet or the like, extending through the openings 14 (FIG. 2) formed near the lower-left corner of each card. The rivet 13 in the disclosed embodiment is nonremovable so that the cards 11 making up the deck 10 are not subject to being misplaced or reassembled out of order by users of the deck. However, it is considered within the scope of the present invention to replace the nonremovable fastener 13 with a removable fastener of known kind, for use in applications where the information appearing on the removable cards 11 is likely to be updated piecemeal from time to time. For other applications where information on all cards of the deck is likely to remain static at least for a time, e.g., for a particular season in the case of a deck pertaining to sports teams and containing schedules and rosters for the teams, a fastener of the nonremovable kind generally is preferred. In any case, it is seen from FIG. 1 that the fastener 13 maintains the cards 11 in a predetermined sequential arrangement, with the cards being mutually parallel but capable of being fanned outwardly as shown in FIG. 1. This structural arrangement of the deck 10 allows fanning the cards so that any particular card beneath the top card 12 becomes visible almost in its entirety, as the cards above that particular card are rotated approximately 180°.

Turning next to FIG. 2, there is shown the nature of selected cards in the deck 10 and the layout of indicia used for indexing and displaying the information on those cards. The top card 12 typically contains wording as described above, and identifying the particular topic or topics of information printed on at least some other cards making up the deck. Immediately following the top card 12, in the disclosed example, are one or more contents cards 18 containing the words "Table of Contents" or similar nomenclature near the top of the card, and also including other indicia 19 naming the information appearing on the specific subject cards following the contents card in the deck 10. If the information printed on the subject cards falls within two or more logical groups of subjects relating to a topic of the deck 10, those different information groups preferably are identified as such by appropriate visual techniques, such as subheadings of bold or otherwise-characteristic type, in the contents indicia 19. Each line item of information appearing on the index card preferably has an index such as a number identifying the particular card or card surface on which that information first occurs.

Appearing along the left marginal portion 20 of the contents card 18 is indicia 21 denoting or identifying the subject matter appearing on that particular card, or at least on the front surface 18a of the card. The indicia 21 preferably includes words such as "Table of Contents" identifying information on the card, as well as nonverbal information identifying a particular kind or class of information characteristic of that found on the front surface 18a. For example, the indicia 21 on the front surface 18a of the card 18 may comprise a border of characteristic color printed along the left marginal portion 20 of the card 18, with the legend "Table of Contents" printed therein. In the particular example given, the indicia 21 for the contents information on the front surface 18a of the card 18 is colored yellow. This color is selected to denote indicia of general interest or assistance relative to the entire contents of the deck 10.

The next card 25 shown in the exploded deck of FIG. 2 contains helpful hints on its front surface 25a and is so identified by the printed indicia "Helpful Hints" near the top of the front surface. The further indicia 26 appears along the left marginal portion 27 of the front surface 25a, and may contain the same title showing the contents of the front surface. The indicia 26 at the left marginal portion of the card preferably has the same color or other nonverbal characteristic as the indicia 21 on the front surface 18a of the card 18, indicating that the front surfaces 18a and 25a each contain information of a general nature pertaining to the topic of the entire deck 10. The indicia 28 appearing below the title near the top of the front surface 25 can be any information of a general or specific nature relating to plants, such as planting, watering, fertilizing, and otherwise caring for the various kinds of plants more particularly identified in the subject cards appearing elsewhere in the deck 10.

Although a single card surface 25a for plant hints is depicted in FIG. 2, it should be understood that this category of general information can be continued on one or more additional card surfaces in the deck. Those additional card surfaces, if they exist, preferably should follow immediately behind the surface 25a on the card 25 for easy and logical access by persons using the deck. Moreover, the card or cards containing hints can be followed in the deck by one or more further cards bearing other information of a general nature relating to a topic of the deck.

Following the general-information card surfaces in the deck 10 are a number of subject cards 31, 32, . . . and so on. Only the two specific subject cards 31 and 32 are shown in FIG. 2, but it will be understood that the number of such cards in a particular deck 10 is limited only by practical considerations relating to the maximum desired thickness of a deck comprising the selected number of subject cards. In the deck of the preferred embodiment, each subject card contains information on a particular plant belonging to a group of plants as defined by horticultural or other characteristics, and preferably as set forth in the indicia 19 on the front surface 18a of the contents card. For example, the card 31 identifies a plant known as "coleus", and that plant name appears at 33 in the indicia band 34 along the left marginal portion of the front surface 31a coleus is deemed an outdoor plant, and the indicia 34 preferably contains nonverbal indicia distinctive of outdoor plants as a group or category of information contained on the various subject cards. In the specific example, the indicia band comprises a green band along the left marginal portion of the front surface 31a, with the word "coleus" appearing superimposed in that colored band. A page number indicated at 35 preferably appears at one end of the indicia along the marginal portion of the front surface 31a, and that page number is keyed to the numerical index contained in the indicia 19 on the contents card. A person seeking information about the particular plant coleus thus can find that card by first reading the Table of Contents on the card surface 18a to determine the page number, and then fanning the cards as shown in FIG. 1 so that the page numbers become visible at the upper end of the marginal indicia on the several cards. Alternatively, a person using the deck could skip the Table of Contents and refer directly to the plant names appearing at 33 in the indicia strips; the plants preferably appear in alphabetical order on the faces 31a, 32a, . . . of the subject cards.

Each subject card, as exemplified by the subject cards 31 and 32 shown in FIG. 2, contain information about a particular subject under the general topic of the deck 10 and, if applicable, under a particular group of subgroup of subjects as outlined on the contents cards 18. Furthermore, in the specific embodiment disclosed herein, the front surface 31a and the back surface 31b of the subject card 31 contain information on different subjects, namely, different species of plants, as is explained below in greater detail. However, it is within the scope of the present invention that both the front and back surfaces of a particular subject card can contain information about a single subject.

The front surface 31 contains at 38 a pictorial representation of the plant "coleus", the subject matter on that card surface. This pictorial representation may be a photograph in color, showing a particular variety of coleus. Immediately to the right of the pictorial representation 30 is printed information setting forth attributes of that particular plant. For example, this information may state that coleus is a "Shade tolerant annual" preferring "rich, moist soil" and growing best in "light to heavy shade". The information to the right of the pictorial representation 38 thus gives the reader some immediate and basic knowledge about the subject described on the front surface 31a.

The remainder of the front surface 31a, appearing below the pictorial representation 38, preferably contains other information relating to coleus and of interest to plant growers.or others. For example, the region 39 can contain a brief description about coleus, including the nature and color of the plant and its leaves as well as other information, and can include a section on preferred care for that particular plant.

Thus, the typical subject card 31, and in particular the front surface 31a, describes a particular plant indicated by the name indicia 33 at the left marginal portion of the front surface, and falling under a particular group of plants ("Outdoor Plants") indicated by the nonverbal indicia 34 also at the left margin of the front surface 31a.

FIG. 3 shows the back surface 31b of the card 31. This back surface 31b, as mentioned above, contains information on another plant, namely, the lily. The name of this plant appears at 40 in the left marginal portion of the back surface 31b, within the further indicia 41 of a nonverbal nature. In a specific embodiment, this nonverbal indicia 41 is a marginal stripe colored orange and extending the length of the back surface 31*b*, the color orange selected to identify bulbs.

The back surface 31*b*, as with the front surface of the card 31, contains a photograph 42 of a particular variety of lily, and includes indicia 43 to the right of the photograph setting forth some attributes of such plants. Further indicia 44 below the photograph 42 include a brief general description of lilies and advice on caring for such plants.

Turning next to the subject card 32 shown in FIG. 2, that the front surface 31*a* of that card is chosen to depict the plant salvia. It should be understood that a typical deck according to the present invention can have many more subject cards than the small number shown in FIG. 2, and that the cards for coleus and salvia are not necessarily contiguous in the deck 10. Further details of the subject card 32 need not be discussed herein, as the information contained on the front surface 32*a* of that card is similar in kind and location to that of the subject card surfaces 31*a* and 31*b* described above. In common with the other subject card surfaces, however, the front surface 32*a* includes at its left margin the verbal indicia 45 identifying the particular plant forming the subject matter of the surface, and the nonverbal indicia 46 identifying the particular group or subgroup of that subject matter.

It should now be apparent that decks according to the present invention can display information on topics virtually without limit. A typical subject card 47 from another such deck is shown in FIG. 4. This subject card 47 is part of an information deck whose topic is professional football, and it will be understood that a complete deck on that topic can contain numerous subject cards, in addition to various cards displaying general information analogous to the hints card 25 and contents card 18 shown and described with respect to FIG. 2. The specific subject card 47, and in particular the front surface 47*a* of that card, deals with the particular subject of a professional football team in Atlanta, and that subject is identified by the text 48 appearing in the marginal band 49 of indicia located adjacent the top surface 50 of the card. The body of the front surface 47*a* contains indicia 51 denoting the playing schedule for the Atlanta professional football team. If the schedule information and size of the card permit, the schedule of another team can appear on the lower half of the front surface 47*a*.

Other topics suitable for inclusion on subject cards of a professional football deck include the roster of players on each team for a particular season, the teams within particular divisions or other groupings in a professional football league, team standings and won-lost records from one or more previous playing seasons, and other information as desired by the preparer of the deck.

Figure 5:
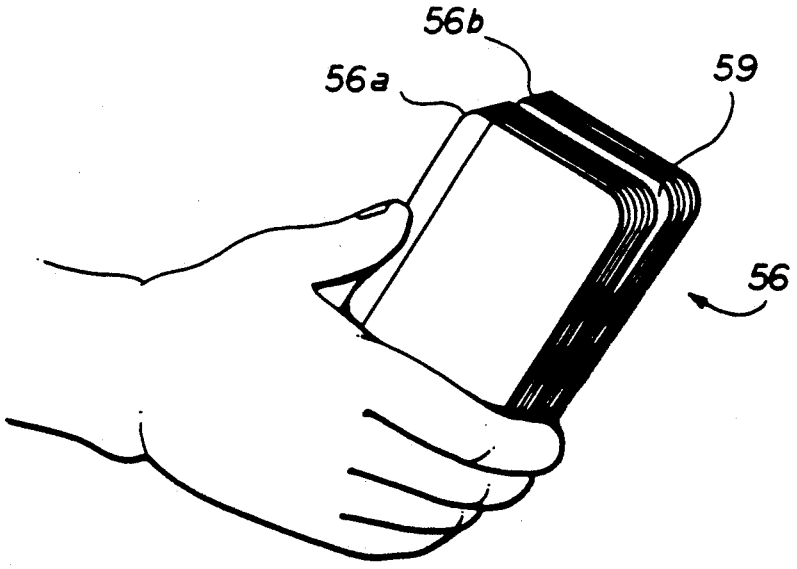
FIG. 5 shows a typical deck compiled according to the prior art.

FIG. 5 shows a typical deck 56 containing information on a selected topic and prepared according to the conventional technique as described below. The individual cards making up the deck 56 are secured together by a rivet in the manner previously described herein with regard to FIG. 1, allowing no excess space or free play between the individual cards but permitting a user to fan the cards. Notwithstanding the snug interconnection provided by the rivet, the deck 56 when held upright as shown in FIG. 5 or when stood upright on a flat surface will naturally split into two card groups 56*a* and 56*b*. A split 59 separates those groups of cards. Although the cards making up the deck 56 are held together at the corner adjacent the rivet, the split 59 in effect radiates outwardly from that corner to define the split between card groups 56*a* and 56*b*. An attempt to reduce or eliminate the split 59 by tightening the riveted connection at the corner does not solve the problem and may actually increase the magnitude of the split. Depending on the particular technique used in preparing the deck 56, more than one split 59 can appear in the deck. These splits are readily visible to the eye and give the impression of an inferior or poorly-constructed product not capable of withstanding extensive use.

An explanation of the conventional technique for preparing and collating the individual cards making up the deck 56 will explain the reason for the split 59 in that deck, and should assist in understanding the present solution to that problem. FIG. 6 shows a layout of the individual faces for a 48-card deck having 96 individual card surfaces. These card surfaces in FIG. 6 are shown numbered seriatim from "1" to "96"; the numbers of the surfaces are enclosed herein in quotation marks to distinguish them from reference numerals on the drawing. It should be understood that FIG. 6 shows two separate layout sheets, and depicts the front surface and the back surface of each separate layout sheet of card stock on which are printed the front and back sides for all 48 cards making up the deck. Thus, one layout sheet has a front surface 62*a* on which are printed 24 card sides, and a back surface 62*b* on which are printed 24 more card sides. The second layout sheet has a front surface 63*a* and a back surface 63*b* on which are printed an additional 48 card sides. The back surfaces 62*b*, 63*b* as shown in FIG. 6 represent the view seen if the cards are flipped about the vertical axis from the front surfaces shown at 62*a*, 63*a*. With that understanding, it will now be seen that the card sides "1" and "96" occupy the same spatial location on opposite surfaces 62*a* and 62*b* of the layout sheet. Likewise, the card sides "2" and "95" occupy the same spatial location on those opposite surfaces of the layout sheet. Thus, once the layout sheet 62 is cut along horizontal and vertical lines to yield 24 cards, one card will have a first side "1" and a second side "96", another card will have sides "2" and "95", and so on.

The remaining 24 cards making up the 48-card set appear on the second layout sheet having the front surface 63*a* and the back surface 63*b*. Thus, the upper-left corner of the front surface 63*a* contains the card side "5", with card "92" appearing at the same spatial location on the back side 63*b* of that layout sheet.

The conventional layout of the 96 card sides shown in FIG. 6 places half of the card front sides "1" through "48" on the back surfaces 62*b* and 63*b* of the two layout sheets. After the individual cards are cut from those layout sheets, half of the cards cut from each sheet must be turned over so that the printed card sides properly collate with the previously-determined seriatim arrangement of the deck. Thus, the card 65 containing card sides "25" on the back surface 63*b* and "72" on the front surface 63*a* is turned over so that the front side "25" faces up toward the front of the deck (and side "72" faces down toward the back of the deck), the proper orientation for those card sides in a deck of 48 cards. Once the cards cut from the two layout sheets are thus collated and assembled in proper order, the cards are drilled and riveted as previously described.

Given the discovery as mentioned above that the grain structure of card stock produces a slight bowing of cards cut from sheets of stock, it should now be apparent from inspection of FIG. 6 that the card sides "1" through "24" are on the front surfaces 62a and 63a of the layout sheets, while the next 12 card front sides "25" through "48" come from the back surfaces 63b and 62b of the layout sheets. Consequently, the first 24 cards of the deck (containing front sides "1" through "24") are bowed in a first direction, and the remaining 24 cards (containing front faces "25" through "48") are bowed in the opposite direction, producing a deck as shown at 56 in FIG. 5 with a split 57 between two groups of cards making up the deck.

Figure 7A:
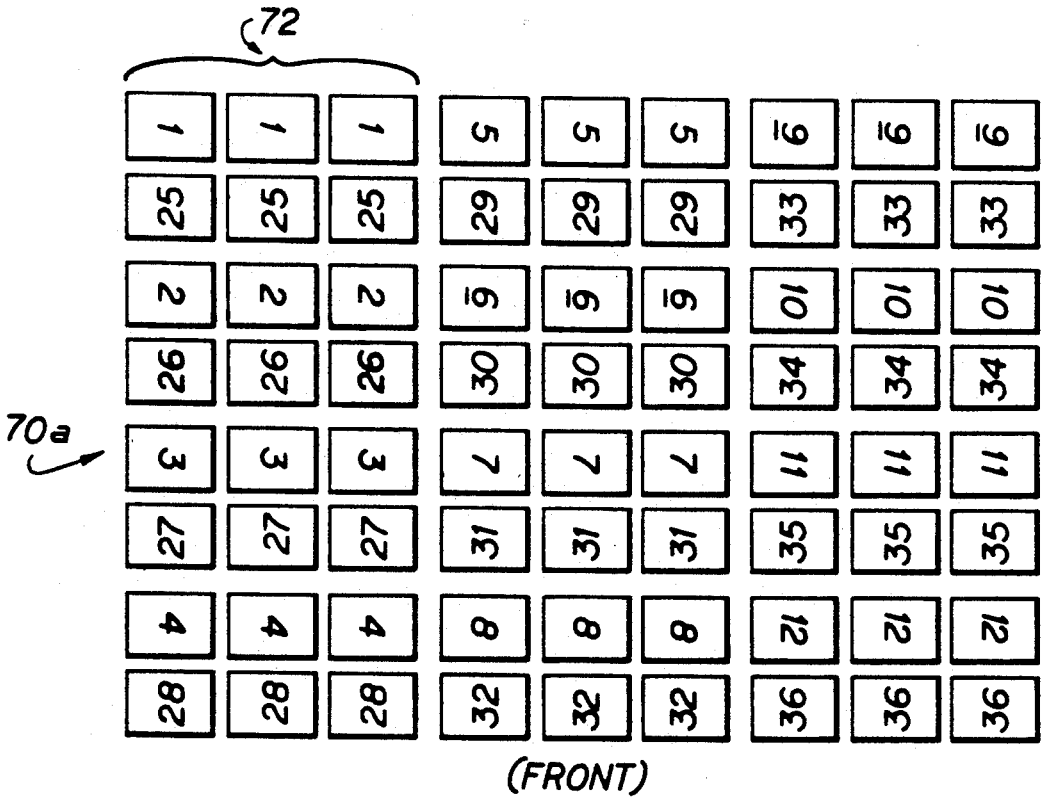
FIGS. 7A and 7B show the layout of card sides on the front and back surfaces of a first sheet according to a preferred embodiment of the invention.
Figure 7B:
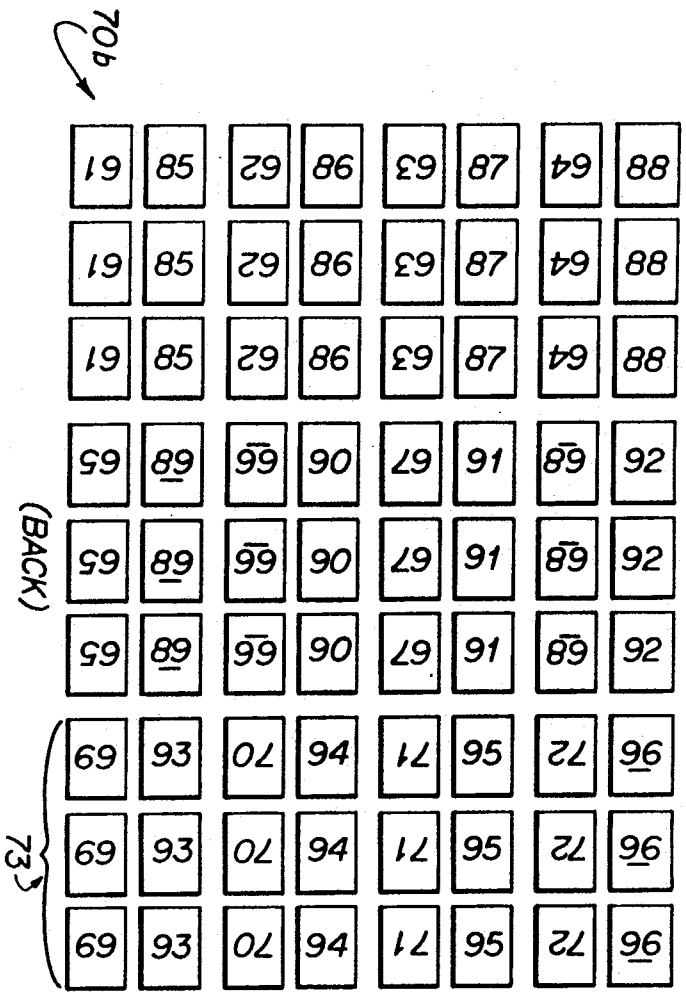
Figure 8A:
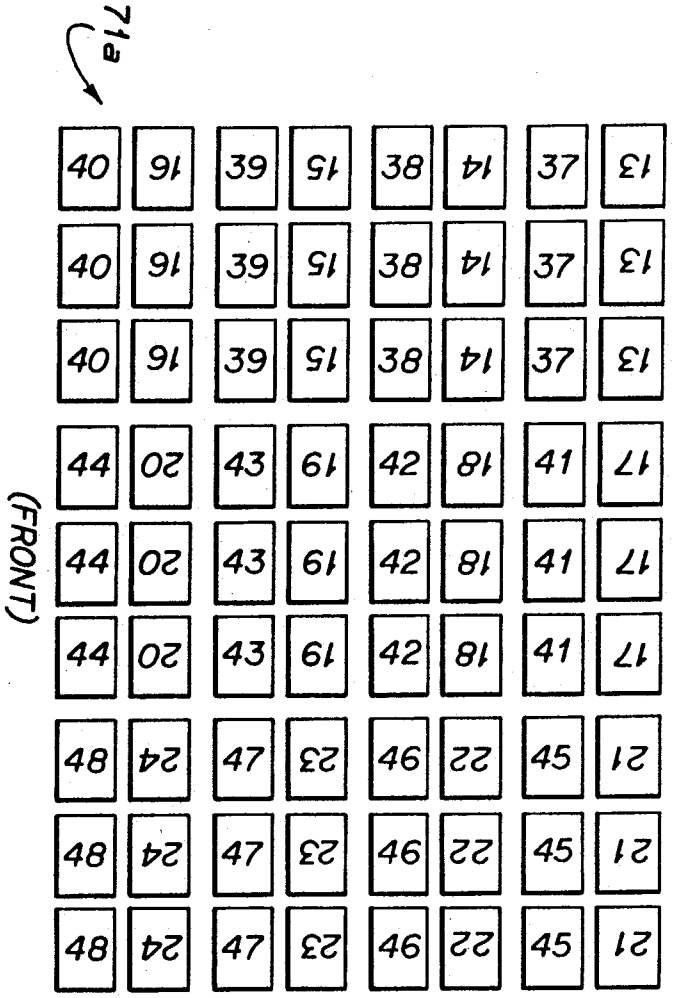
FIGS. 8A and 8B show the layout of card sides on the front and back surfaces of a second sheet according to the preferred embodiment.
Figure 8B:
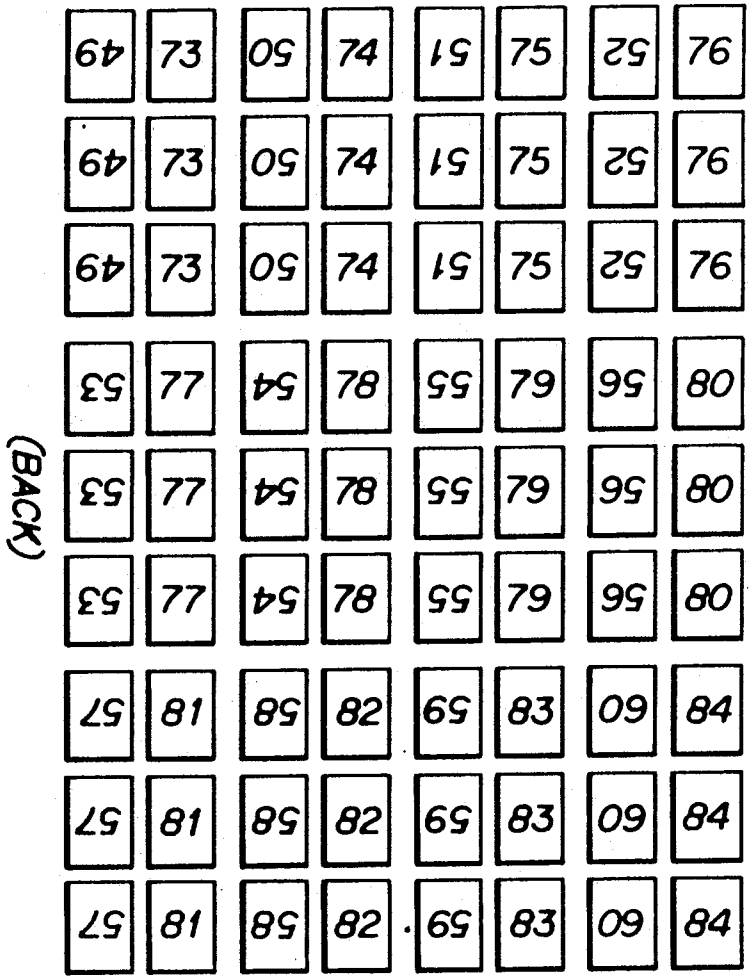

FIGS. 7A, 7B and FIGS. 8A, 8B show layout sheets for producing decks without the problem of splitting encountered with the conventional method as discussed above. FIG. 7A shows at 70a the front surface of a first layout sheet, the back surface 70b of that layout sheet being shown in FIG. 7B. Likewise, the front surface 71a of a second layout sheet is shown in FIG. 8A, and the back surface 71b of that layout sheet is shown in FIG. 8B. Once again, the quoted numbers "1" through "96" represent card sides in these layout sheets. However, it can be seen from FIG. 7A, for example, that each layout sheet contains the card sides in triplicate. That is, the front surface 70a of the first layout sheet contains three individual card sides "1" collectively designated at 72. The back sides "96" of those three cards are shown at 73 on the back surface 70b of that layout sheet, FIG. 7B. Thus, the single layout sheet shown in FIGS. 7A and 7B, when printed on both surfaces and cut into separate cards, yields cards for compiling into three separate decks commencing with card side "1".

From inspecting the front surface 70a of the first sheet, it is seen that card sides "1" through "12" and "25" through "36" appear thereon. The front surface 71a, FIG. 8A, of the second layout sheet contains the card sides "13" through "24" and "37" through "48". Thus, the front surfaces 70a and 70b of the two sheets contain all 48 front card sides for three 96-card decks. The card sides "49" through "96" appear on the back surfaces 70b and 71b of the first and second sheets.

Once the layout sheets shown in FIGS. 7A, 7B and FIGS. 8A, 8B are cut into separate cards, those cards can be collated into three separate decks without turning over any card. Thus, the front sides of all 48 cards in each deck come from the front surfaces 70a or 70b of the layout sheets. This means the cards of each deck all bow in the same direction, avoiding the split 57 (FIG. 5) that heretofore appeared when the decks were laid out and collated and riveted together.

Although the layout sheets shown in FIGS. 7 and 8 have each card side in triplicate, it should be understood that such multiple occurrences of the same card sides on a single sheet of card stock is a choice only of production economy and does not per se form part of the present invention. An alternative arrangement wherein a lesser or greater number of duplicate card sides appear on each layout sheet is considered within the scope of the present invention. Thus, the term "card stock" is used herein to mean one or more sheets of material, "front surface" refers to a first surface of the card stock having the same direction of bowing, and "back surface" refers to the opposite surface of the card stock. Whether the layout of a particular deck uses one or more sheets of card stock is irrelevant to the present invention as long as all such sheets have the same front surface-back surface alignment when the card faces are printed on the card stock.

It should be understood that the foregoing relates only to a preferred embodiment of the present invention, and that numerous modifications and changes therein may be made without departing from the spirit and scope of the invention as defined in the following claims.

What is claimed is:

1. The method of producing a deck of cards containing a certain number of cards from plural sheets of card stock and said plural sheets being slightly warped instead of being absolutely flat, each card having a front side and a back side, comprising the steps of:

printing the front sides of all the cards of the deck on said card stock sheets;

printing the back sides of all said cards on said second surfaces of card stock sheets in registry with the card front sides;

cutting individual cards from the card stock sheets so that each card contains a front side and a back side as previously printed on the card stock sheets; and assembling the cards into a deck in predetermined order so that the front sides of all cards face a predetermined side of the deck, whereby the cards making up the deck have a common planar orientation on the card stock sheets and lie alongside one another in close juxtaposition without producing the appearance of a split between front and back portions of the deck arising from warped card stock.

2. The method as in claim 1, wherein the step of assembling the cards comprises fastening the cards together so that the cards are held flat against one another to permit fanning the cards for viewing any particular card.

* * * * *